US008197274B2

(12) United States Patent
Bodmann et al.

(10) Patent No.: US 8,197,274 B2
(45) Date of Patent: Jun. 12, 2012

(54) TORSIONAL CONTACT DEVICE AND METHOD FOR ELECTRONICS MODULE

(75) Inventors: Douglas R. Bodmann, Shaker Heights, OH (US); Nathan J. Molnar, Shaker Heights, OH (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 38 days.

(21) Appl. No.: 12/858,756

(22) Filed: Aug. 18, 2010

(65) Prior Publication Data

US 2012/0045940 A1 Feb. 23, 2012

(51) Int. Cl.
*H01R 29/00* (2006.01)

(52) U.S. Cl. ..... 439/188; 439/637; 439/928

(58) Field of Classification Search ..... 439/626, 439/631, 717, 716, 636, 928, 637, 188
See application file for complete search history.

(56) References Cited

U.S. PATENT DOCUMENTS

| | | | | | |
|---|---|---|---|---|---|
| 2,154,301 | A | | 4/1939 | Clement | |
| 3,955,875 | A | * | 5/1976 | Petiot | 439/631 |
| 4,322,120 | A | * | 3/1982 | Rilling | 439/631 |
| 4,863,394 | A | | 9/1989 | Henshaw, Jr. | |
| 4,872,851 | A | | 10/1989 | Babuka et al. | |
| 4,897,054 | A | * | 1/1990 | Gilissen et al. | 439/631 |
| 4,999,787 | A | | 3/1991 | McNally et al. | |
| 5,336,094 | A | | 8/1994 | Johnson | |
| 5,584,030 | A | | 12/1996 | Husak et al. | |
| 6,017,246 | A | * | 1/2000 | Hisazumi et al. | 439/637 |
| 6,027,379 | A | | 2/2000 | Hohorst | |
| 6,086,427 | A | * | 7/2000 | Cahaly | 439/631 |
| 6,171,138 | B1 | | 1/2001 | Lefebvre et al. | |
| 6,447,309 | B1 | | 9/2002 | Ko et al. | |
| 6,764,345 | B1 | * | 7/2004 | Duesterhoeft et al. | 439/637 |
| 6,860,766 | B2 | | 3/2005 | Aujla et al. | |

* cited by examiner

*Primary Examiner* — Hae Moon Hyeon
(74) *Attorney, Agent, or Firm* — Fay Sharpe LLP; R. Scott Speroff; John M. Miller

(57) ABSTRACT

A torsional electrical contact includes a body including a helix with N turns around an axis, N≧1. The body includes first and second ends. First and second contact arms extend outwardly away from the helix. The contact arms include respective distal ends. The arms define a contact angle α. At least one of the first and second contact arms is selectively resiliently movable toward the other of the first and second contact arms to reduce the contact angle α. One or more contacts are installed in a module and/or connected to an electronic component. A module including first and second contacts can be configured in a first condition in which the contacts are connected directly to each other or a second condition in which the contacts are engaged with respective parts of a circuit board or other component inserted into the housing according to a disclosed method.

20 Claims, 8 Drawing Sheets

TORSIONAL CONTACT DEVICE AND METHOD FOR ELECTRONICS MODULE

BACKGROUND

A wide variety of electrical contacts for electronics modules are known. Examples include straight or curved beams or pads that deflect to accommodate a mating circuit board or other component. Other examples are rigid beams or pads or other structures that make sliding contact with a mating component including one or more rigid or deflectable mating contacts, such as a knife and fork contact system in which a knife contact is slid between first and second contacts of a fork element.

These prior contacts have been found to be suboptimal in certain applications where it is necessary to provide a robust electrical connection in combination with the need to alter the make/break sequence and/or in combination with the need to tune the stiffness of the contacts to adjust contact pressure to balance the need for sufficient contact pressure against the desirability of ease of connection/disconnection with a mating component.

SUMMARY

In accordance with one aspect of the present development, a torsional electrical contact includes a body comprising a helix including N helical turns around a longitudinal axis, wherein $N \geqq 1$. The body further includes first and second opposite ends that are spaced longitudinally from each other. First and second contact arms extend outwardly away from the helix at the opposite first and second ends of the body, respectively. The first and second contact arms include respective distal ends defined by a part of the contact arm that is located a maximum orthogonal distance from the longitudinal axis. The first and second arms define a contact angle $\alpha$ measured between a first reference plane in which the longitudinal axis lies and that intersects the distal end of the first contact arm and a second reference plane in which the longitudinal axis lies and that intersects the distal end of the second contact arm. At least one of the first and second contact arms is selectively resiliently movable toward the other of the first and second contact arms to reduce the contact angle $\alpha$.

In accordance with another aspect of the present development, one of the first and second arms of the contact is connected to a circuit board or other electronic component and the other arm is free and adapted for being contacted by an associated component.

In accordance with another aspect of the present development, the contact is installed in an electronic module, with one of the contact arms located inside the module and one of the contact arms exposed through a wall of the module.

In accordance with another aspect of the present development, an electronics module includes a module housing and first and second torsional contacts connected to the module housing. Each of the first and second torsional contacts includes: a body including a helix with at least one helical turn around a longitudinal axis. The body including first and second opposite ends that are spaced longitudinally from each other. First and second contact arms extend outwardly away from the helix at the opposite first and second ends of the body, respectively.

In accordance with a further aspect of the present development, a method of changing the condition of an electronics module from a first condition to a second condition includes providing electronics module in a first condition including a module housing and first and second torsional contacts connected to the module housing. Each of the first and second torsional contacts includes: (i) a body with a helix including at least one helical turn around a longitudinal axis, the body including first and second opposite ends that are spaced longitudinally from each other; and, (ii) first and second contact arms extending outwardly away from the helix at the opposite first and second ends of the body, respectively, wherein the second contact arms of said first and second torsional contacts are in contact with each other. The method further includes inserting a circuit board between the first and second torsional contacts to deflect the respective second contact arms of the first and second torsional contacts away from each other to define the second condition of the electronics module in which the second contact arm of the first torsional contact is located on a first side of the circuit board and the second contact arm of the second torsional contact is located on a second side of the circuit board.

BRIEF DESCRIPTION OF DRAWINGS

FIG. 8 shows first and second torsional contacts each formed in accordance with the present development and operatively arranged to receive a circuit board or other electronic component there between.

DETAILED DESCRIPTION

Figure 1A:
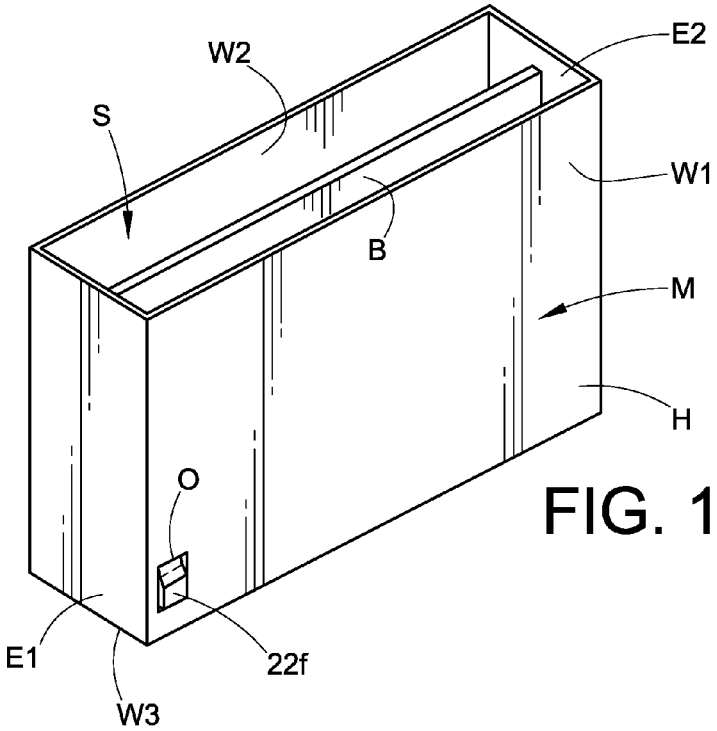
FIGS. 1A and 1B are respective right and left isometric views of an electronics module provided in accordance with the present development.
Figure 1B:
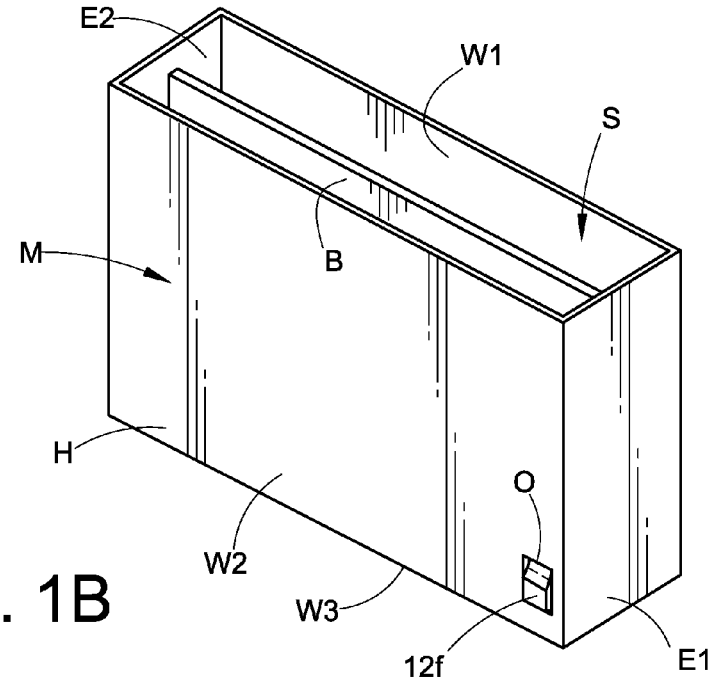

FIGS. 1A and 1B are respective right and left isometric views of an electronics module M provided in accordance with the present development. The module M comprises a module housing H defined from a molded polymeric or other material. The housing H defines an interior space S that is adapted to receive and retain electronic components such as the circuit board B. More particularly, the space S is defined between first and second parallel spaced-apart side walls W1,W2 of the housing H. First and second end walls E1,E2 extend between and interconnect the side walls W1,W2, and a bottom wall W3 closes the bottom of the space S. Although not shown, the module M typically comprises a removable face plate that encloses the open top of space S and that includes switches, plugs/connectors, LEDs and other electronic components that operatively connect to the circuit board B when the face plate is installed. The module M can be any electronics module including one or more electronic components and/or an electrical device such as a battery pack or can be any other enclosure or housing including an electrical and/or electronic device connected thereto and/or contained therein.

Figure 2:
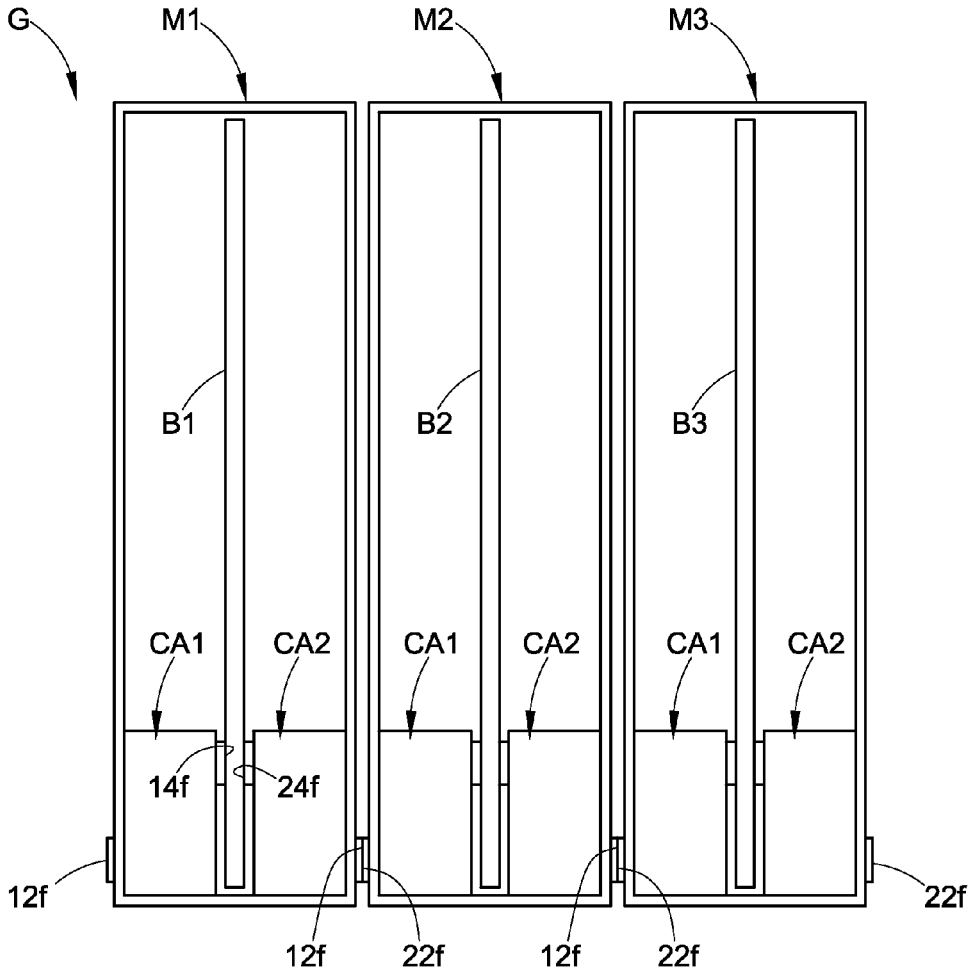
FIG. 2 is a top view showing three electronics modules according to the present development operatively connected to each other to define a group of electronics modules.

FIG. 2 is a top view showing three electronics modules M (M1,M2,M3) each defined according to the present development and operatively connected to each other to define a group G of modules. Each module M comprises first and second torsional contact assemblies CA1,CA2 connected to the housing H. As shown separately in FIG. 5A, the first contact assembly CA1 includes a contact housing CH and a first torsional contact C1 installed in the contact housing and comprising first and second contact faces 12*f*,14*f*. As shown separately in FIG. 5B, the second contact assembly CA2 includes a contact housing CH and a second torsional contact C2 installed in the contact housing and comprising first and second contact faces 22*f*,24*f*.

Figure 3B:
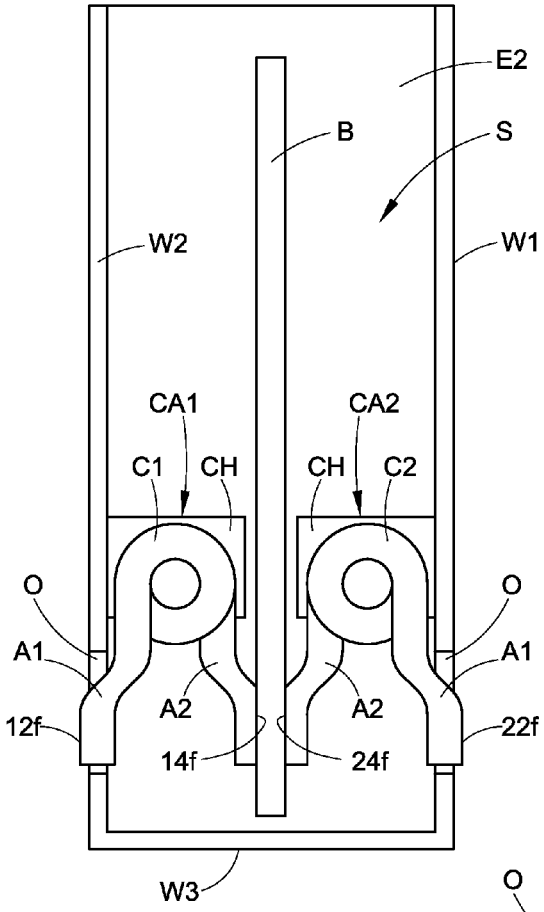
FIG. 3B shows the electronics module of FIG. 3A in its second operative condition.
Figure 3A:
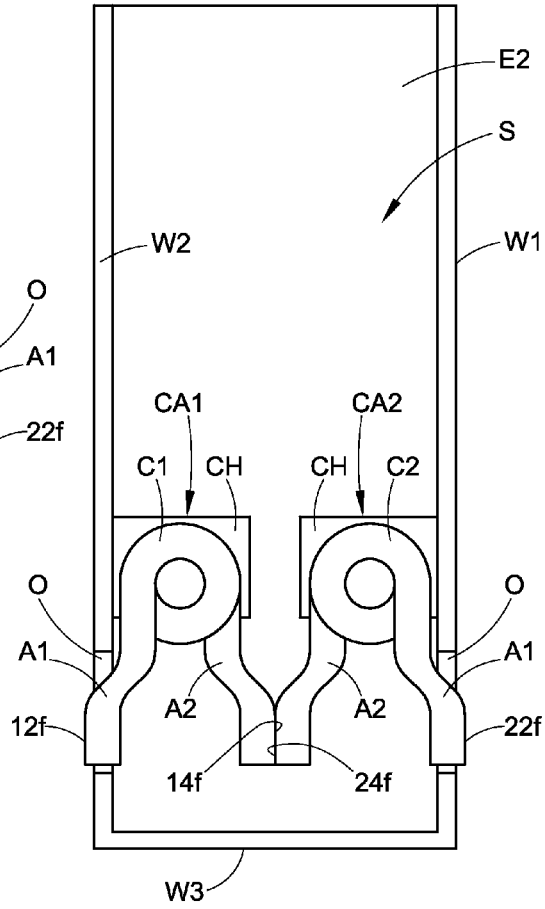
FIG. 3A shows an electronics module according to the present development, with the module in its first operative condition.

Referring also to FIGS. 3A and 3B, the first contact face 12*f* of the first contact C1 is located adjacent and is exposed through or otherwise relative to the first side wall W1, and the first contact face 22*f* of the second contact C2 is located adjacent and is exposed through or otherwise relative to the second side wall W2. As shown the side walls W1,W2 include openings O through which the first contact faces 12*f*,22*f* are respectively exposed and extend such that the first contact faces 12*f*,22*f* project respectively outward from the side walls W1,W2 and are adapted to make electrical contact with an associated electrical component/contact. The second contact faces 14*f*,24*f* of the first and second contacts C1,C2 are located inside the module space S. FIG. 3A shows the module M in a first condition, in which the second contact faces 14*f*,24*f* are abutted and electrically connected with each other when the circuit board B is removed from the space S. FIG. 3B shows the module M in a second condition, in which the second contact faces 14*f*,24*f* are spaced-apart from each other and separated by the circuit board B when the circuit board is installed, such that the contact faces 14*f*,24*f* are in contact with and electrically connected to opposite sides of the circuit board B. In the first condition (FIG. 3A) the first and second contacts C1,C2 conduct electrical signals (power and/or data) from one of the first contact faces 12*f*,22*f* to the other through the abutted second contact faces 14*f*,24*f*. In the second condition (FIG. 3B), the first and second contacts C1,C2 conduct electrical signals (power and/or data) to and from the circuit board B and its electrical components and/or from one of the first contact faces 12*f*,22*f* to the other through the circuit board B.

The first and second contacts C1,C2 are structured and dimensioned and arranged relative to each other such that they are normally located in the first condition, with their second contact faces 14*f*,24*f* abutted (FIG. 3A), and such that the second contact faces 14*f*,24*f* are selectively resiliently movable away from each other by insertion of the circuit board B or another electronic component into the space S between the contact faces 14*f*,24*f*. The first and second contacts C1,C2 are resiliently structured such that the contact faces 14*f*,24*f* naturally and automatically return to the first condition in abutment with each other when the circuit board B or other component located between the faces 14*f*,24*f* is removed. Those of ordinary skill in the art will recognize that a first pair of contacts C1,C2 can be connected to the module M at a first location and a second pair of contacts C1,C2 can be connected to the module M at a second location, such that one of the pairs of contacts is the "make first, break last" pair in which the contacts C1,C2 thereof are the first contacts to change from the first condition to the second condition upon insertion of the circuit board B, and the same pair of contacts C1,C2 is the last to change from the second condition to the first condition upon removal of the circuit board B. Such arrangements can enable a removal and insertion under power (RIUP) contact system by controlling the connect/disconnect sequence of the contacts.

FIG. 2 shows the group G of modules M, with each module M (M1,M2,M3) in its second operative condition such that power and/or data electrical signals are conducted to and between each of the modules M and the circuit boards B respectively installed in the spaces S of the modules M. It can be seen that the first contact face 12*f* of the middle module M2 is abutted with and electrically connected to the first contact face 22*f* of the left module M1, and the first contact face 22*f* of the middle module M2 is abutted with and electrically connected to the first contact face 12*f* of the right module M3. The respective circuit boards B (B1,B2,B3) of the modules M1,M2,M3 are thus electrically connected to each other for transmission of power and/or data there between as required, and for transmission of power and/or data from the first contact face 12*f* of the module M1 located at one end of the of the group G to the first contact face 22*f* of the module M3 located at the opposite end of the group G.

Figure 4:
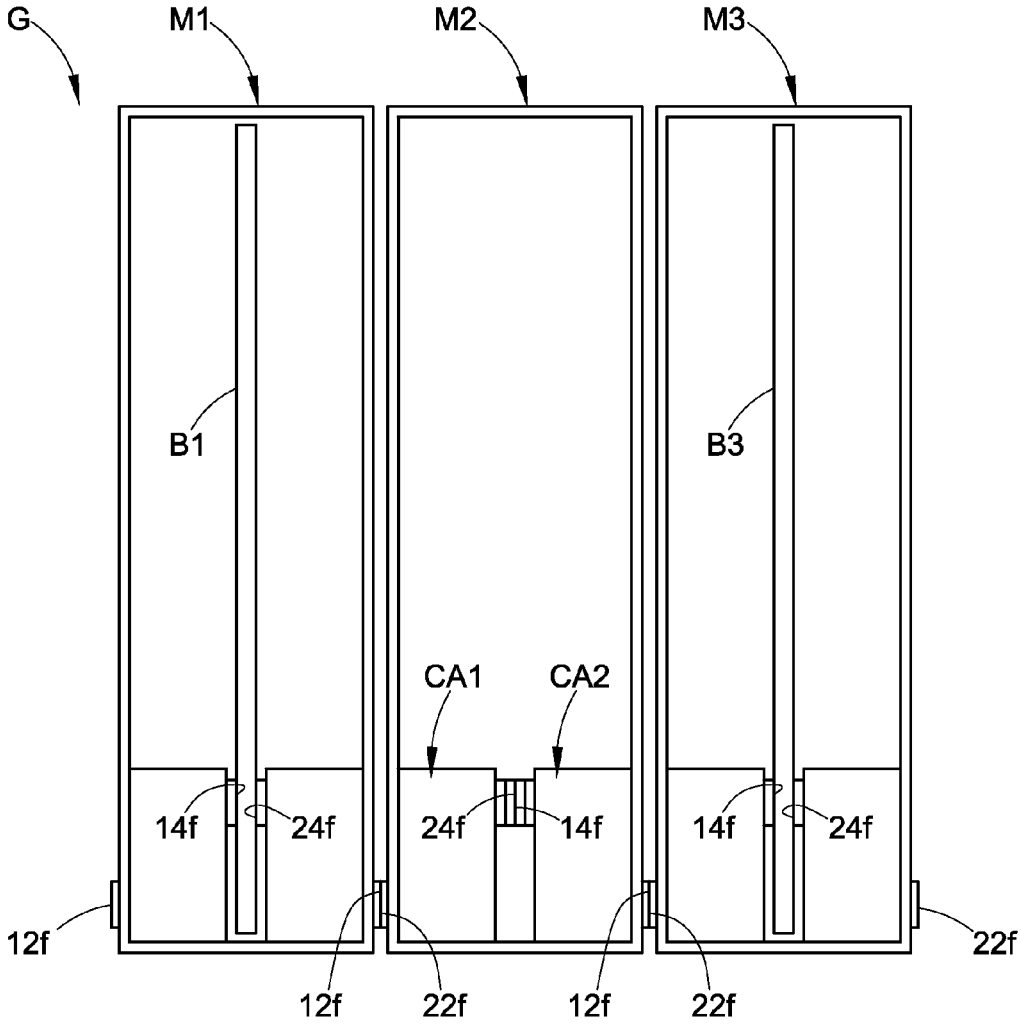
FIG. 4 is identical to FIG. 2, but shows the central electronics module in the first operative condition while the left and right electronics modules are in the second operative condition.

FIG. 4 is identical to FIG. 2, but shows the central electronics module M2 in the first operative condition while the left and right electronics modules M1,M3 are in the second operative condition. The circuit board B2 has been removed from the space S of the module M2, but the flow of data/power electrical signals through the module M2 to and from the modules M1,M3 is not interrupted because the second contact faces 14*f*,24*f* of the first and second contact assemblies CA1, CA2 of the module M2 are abutted with and electrically connected to each other.

Figure 5A:
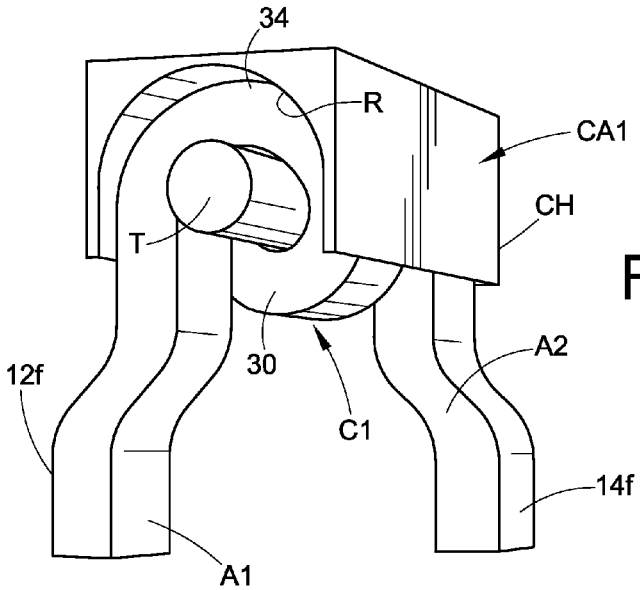
FIGS. 5A and 5B respectively show first and second torsional contact assemblies according to the present development.
Figure 5B:
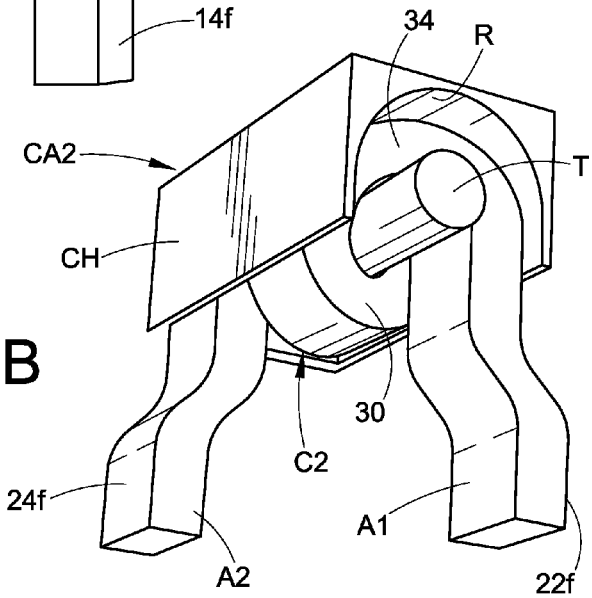
Figure 5C:
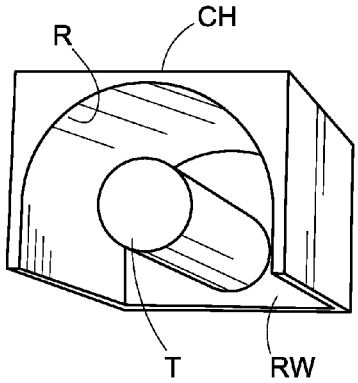
FIG. 5C shows the contact housing portion of the torsional contact assemblies of FIGS. 5A and 5B.

As noted above, in the illustrated embodiment, the first and second torsional contacts C1,C2 are provided as part of respective first and second contact assemblies CA1,CA2 as shown in FIGS. 5A and 5B, wherein the contacts C1,C2 are installed in respective contact housings CH. FIG. 5C shows the contact housing CH by itself. It can be seen that the contact housing CH comprises a one-piece construction from an electrically insulative material such as a molded polymeric material. The contact housing CH comprises a recess R in which a helical body 30 of the contact C1,C2 is located. An end wall RW closes one end of the recess R and a post T projects outwardly from the end wall RW. The post T is coaxially installed through the core of the helical body 30 and projects outwardly from the end of the helical body.

Figure 6A:
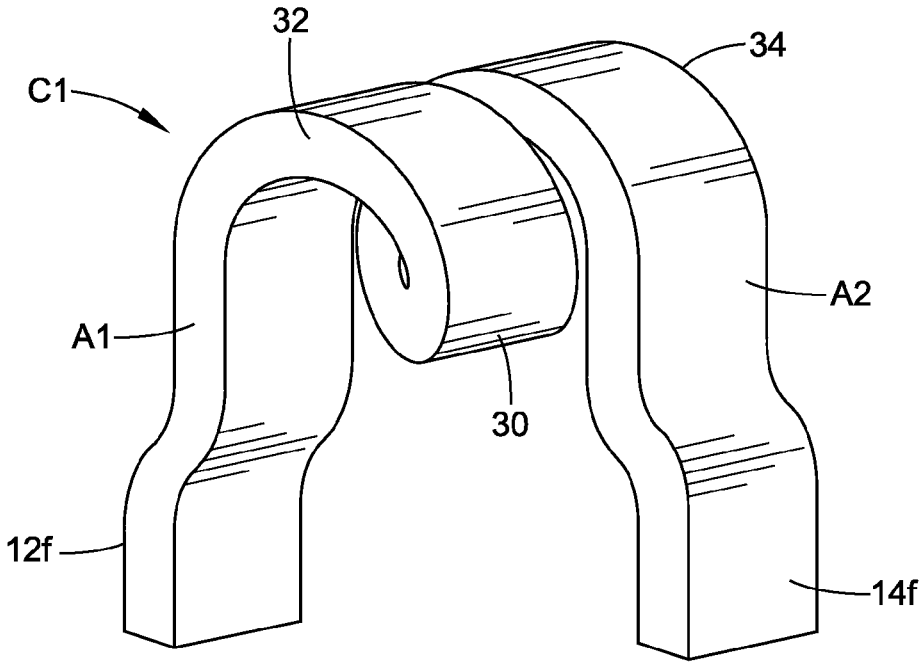
FIG. 6A is an isometric view of a first torsional contact formed in accordance with the present development comprising a right-handed helical body.
Figure 6B:
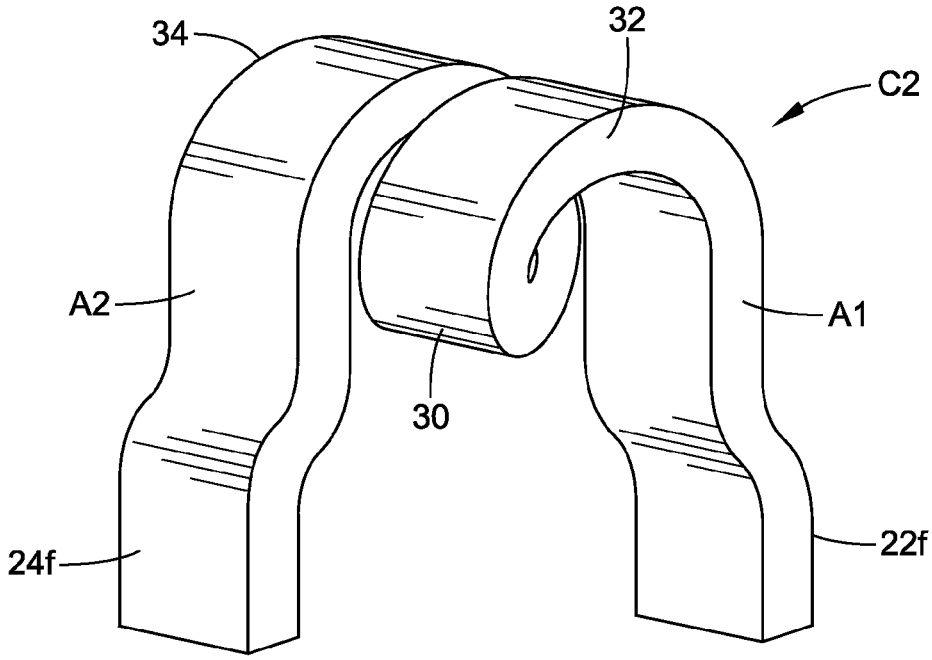
FIG. 6B is an isometric view of a second torsional contact formed in accordance with the present development comprising a left-handed helical body.

The first and second contacts C1,C2 are shown respectively in FIGS. 6A and 6B. Each contact C1,C2 comprises a body 30 defined by a helix including N helical turns around a longitudinal axis X (FIG. 8), wherein N≧1 but need not be an integer. For example, N can equal 1.5 or 2.3, etc. Each helical body 30 body comprises first and second opposite ends 32,34 that are spaced longitudinally from each other. A first contact arm A1 extends outwardly away from the first end 32 of the helical body 30, transversely relative to the axis X, and a second contact arm A2 extends outwardly away from the second end 34 of the helical body 30, transversely relative to the axis X. The first and second contact arms A1,A2 of the first torsional contact C1 respectively include or define the first and second contact faces 12*f*,14*f*. The first and second contact arms A1,A2 of the second torsional contact C2 respectively include or define the first and second contact faces 22*f*,24*f*.

Figure 8:
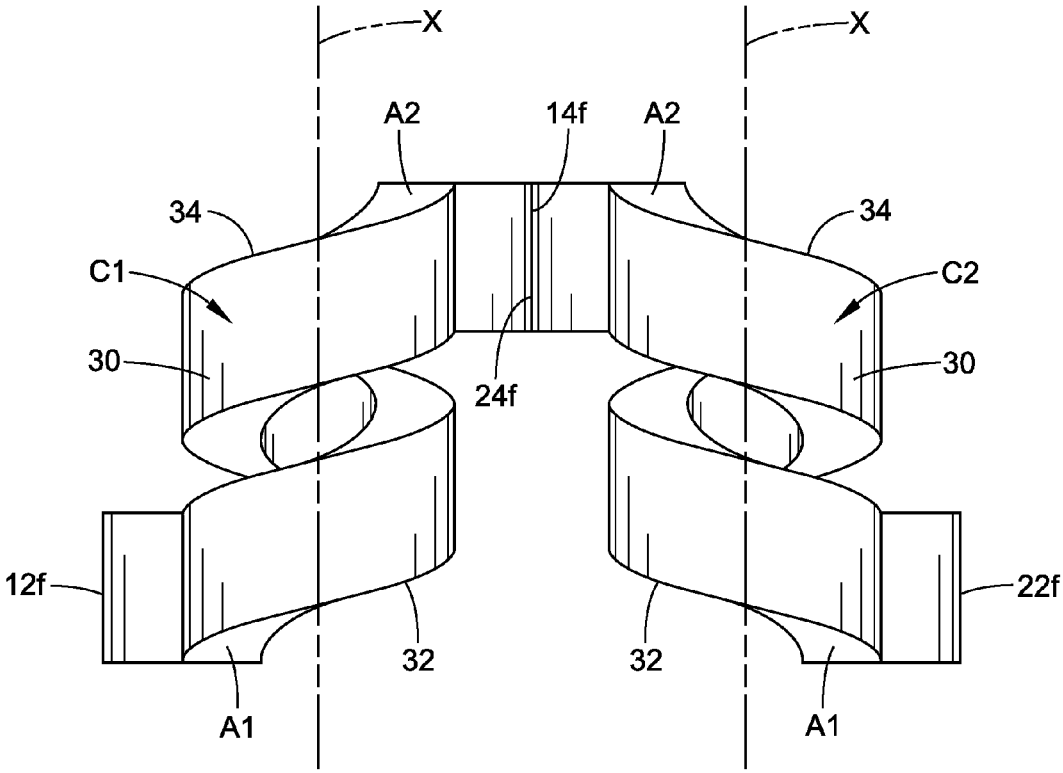

With reference also to FIG. 8, it can be seen that the body 30 of the first torsional contact C1 is defined with a right-hand helix and the body 30 of the second torsional contact C2 is defined with a left-hand helix.

Figure 7A:
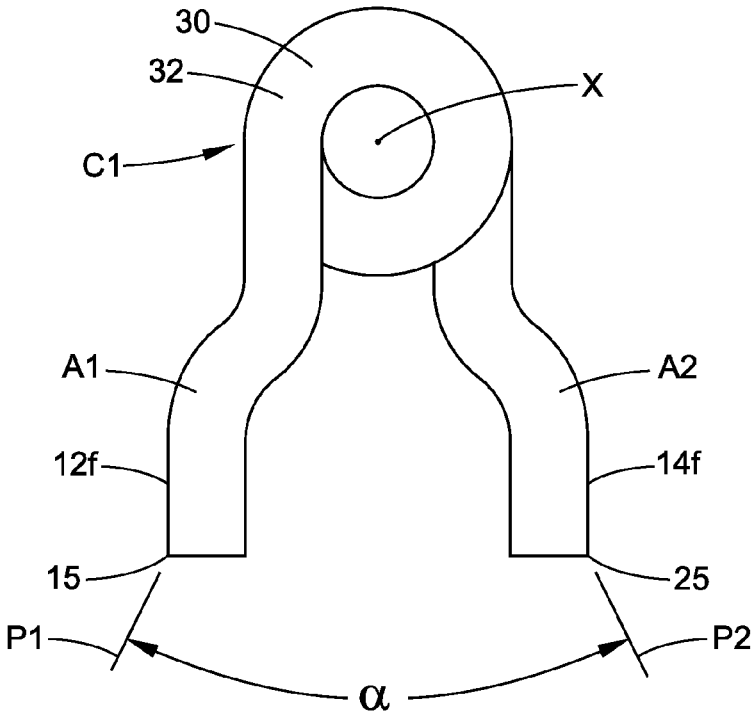
FIGS. 7A and 7B is a front views of the torsional contacts of FIGS. 6A and 6B.
Figure 7B:
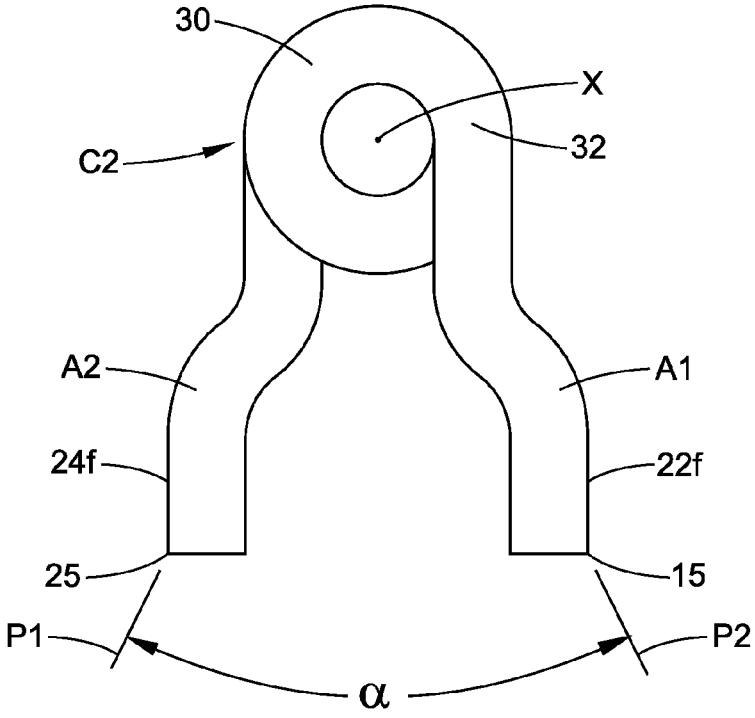

Referring also to FIGS. 7A and 7B, the first and second contact arms A1,A2 comprise respective distal ends 15,25 defined by the part of the contact arm that is located a maximum orthogonal distance from the longitudinal axis X. The first and second contact arms A1,A2 define the contacts C1,C2 to have a contact angle α. The contact angle α is measured between a first reference plane P1 in which said longitudinal axis X lies and that intersects said distal end 15 of said first contact arm A1, and a second reference plane P2 in which said longitudinal axis X lies and that intersects said distal end 25 of said second contact arm A2. When the contact C1,C2 is in a free state, the contact angle is defined such that α<180 degrees. The first and second contact arms A1,A2 are selectively resiliently movable toward each other to reduce the contact angle α, but move resiliently back to their free state when released. Unlike beam-type contacts, it is possible to control the force required to move the first and second contact arms A1,A2 resiliently toward each other to reduce the contact angle α by controlling the number of helical turns N used to define the body 30 of each contact C1,C2. Thus, the force required to move the second contact faces 14*f*,24*f* apart from each other during insertion of the circuit board B, and the force exerted by the second contact faces 14*f*,24*f* on the circuit board B when it is installed increase as the number of helical turns N increases. With this configuration it is possible for different contacts in a system to exhibit different contact forces by controlling the number of helical turns N of the respective contacts. For each contact C1,C2, the body and the first and second contact arms A1,A2 are defined as a one-piece construction from an electrically conductive resilient material such as a suitable electrically conductive metal, e.g., copper, aluminum, stainless steel, etc. As shown, the material from which the contacts C1,C2 are defined includes a rectangular cross-section, which results in the contact faces 12*f*,14*f*,22*f*,24*f* being defined by respective outwardly oriented planar surfaces of the rectangular cross-section material. As shown in FIGS. 7A and 7B, in the illustrated embodiment, the first and second contact faces 12*f*,22*f* and the first and second contact faces 22*f*,24*f* lie in respective parallel planes.

In an alternative embodiment, a contact C1 or C2 is connected to a circuit board or other electronic component by soldering or otherwise connecting one of its arms A1,A2 thereto such that the other arm A1,A2 is free and adapted for selective engagement with a mating contact/component.

The development has been described with reference to preferred embodiments. Those of ordinary skill in the art will recognize that modifications and alterations to the preferred embodiments are possible. The disclosed preferred embodiments are not intended to limit the scope of the following claims, which are to be construed as broadly as possible, whether literally or according to the doctrine of equivalents.

The invention claimed is:

1. A torsional electrical contact comprising:

a body comprising a helix including N helical turns around a longitudinal axis, wherein N≧1, said body further comprising first and second opposite ends that are spaced longitudinally from each other;

first and second contact arms extending outwardly away from said helix at said opposite first and second ends of said body, respectively, said first and second contact arms comprising respective distal ends defined by a part of said contact arm that is located a maximum orthogonal distance from said longitudinal axis;

said first and second arms defining a contact angle α, wherein said contact angle a is measured between a first reference plane in which said longitudinal axis lies and that intersects said distal end of said first contact arm, and a second reference plane in which said longitudinal axis lies and that intersects said distal end of said second contact arm;

wherein at least one of said first and second contact arms is selectively resiliently movable toward the other of said first and second contact arms to reduce said contact angle α.

2. The torsional contact as set forth in claim 1, wherein said body and said first and second contact arms are defined as a one-piece construction from an electrically conductive material.

3. The torsional contact as set forth in claim 2, wherein one of said first and second contact arms is connected to an electronic component and the other of said first and second contact arms is free.

4. The torsional contact as set forth in claim 2, wherein a torsional force required to move said first and second contact arms resiliently toward each other to reduce said contact angle α is proportional to N such that said torsional force increases as N increases.

5. The torsional contact as set forth in claim 4, wherein said first and second contact arms comprise respective contact faces that lie in respective first and second planes when said first and second contact arms are in a free state.

6. The torsional contact as set forth in claim 5, wherein said respective contact faces of said first and second contact arms comprise planar surfaces.

7. The torsional contact as set forth in claim 1, wherein said contact angle α<180 degrees.

8. The torsional contact as set forth in claim 1, further comprising an electrically non-conductive contact housing that supports said contact, said housing comprising a recess in which said helix is located and comprising a post that extends through a center of said helix so as to be coaxial with said longitudinal axis.

9. The torsional contact as set forth in claim 8, wherein said post includes a first end connected to a transverse end wall located at one end of said recess and includes a second end that projects outwardly from said first end of said body.

10. The torsional contact as set forth in claim 8, installed in an electronics module, wherein said first contact arm is exposed through a first sidewall of said housing and said second contact arm is located inside an interior space of said module.

11. An electronics module comprising:

a module housing;

first and second torsional contacts connected to said module housing, each of said first and second torsional contacts comprising:

a body comprising a helix including at least one helical turn around a longitudinal axis, said body comprising first and second opposite ends that are spaced longitudinally from each other; and, first and second contact arms extending outwardly away from said helix at said opposite first and second ends of said body, respectively.

12. The electronics module as set forth in claim 11, wherein:

said first contact arm of said first torsional contact includes a contact face that is located adjacent a first wall of said module housing;

said first contact arm of said second torsional contact includes a contact face that is located adjacent a second wall of said module housing; and, said second contact arm of said first torsional contact and said second contact arm of said second torsional contact are located inside said module housing and include respective contact faces that are abutted with each other in a first condition of said electronics module and that are spaced-apart from each other in a second condition of said electronics module.

13. The electronics module as set forth in claim 12, further comprising a circuit board installed in said electronics module, said circuit board located between said second contact arms of the first and second torsional contacts to define said second condition of said electronics module, said circuit board selectively removable from said module to define said first condition of said electronics module.

14. The electronics module as set forth in claim 12, further comprising first and second contact housings that respectively connect said first and second torsional contacts to said module housing, wherein:

said first contact housing comprises a recess in which said helix of the first torsional contact is located and a post that extends coaxially through the helix of the first torsional contact;

said second contact housing comprises a recess in which said helix of the second torsional contact is located and a post that extends coaxially through the helix of the second torsional contact.

15. The electronics module as set forth in claim 11, wherein, for each of said first and second torsional contacts:

said first and second contact arms include respective distal ends defined by a part of said contact arm that is located a maximum orthogonal distance from said longitudinal axis;

said first and second arms define a contact angle $\alpha$, wherein said contact angle $\alpha$ is measured between a first reference plane in which said longitudinal axis lies and that intersects said distal end of said first contact arm, and a second reference plane in which said longitudinal axis lies and that intersects said distal end of said second contact arm;

wherein said first and second contact arms are selectively resiliently movable toward each other to reduce said contact angle $\alpha$.

16. The electronics module as set forth in claim 15, wherein said first and second torsional contacts are defined as respective one-piece constructions from an electrically conductive material.

17. The electronics module as set forth in claim 16, wherein said helix of each of said first and second torsional contacts comprises N complete helical turns around its longitudinal axis, wherein $N \geqq 1$, and wherein a torsional force required to move said first and second contact arms resiliently toward each other to reduce said contact angle $\alpha$ is proportional to N such that said torsional force increases as N increases.

18. The electronics module as set forth in claim 16, wherein said contact angle $\alpha < 180$ degrees.

19. The electronics module as set forth in claim 11, wherein:

said helix of said body of one of said first and second torsional contacts is a right-handed helix;

said helix of said body of the other of said first and second torsional contacts is a left-handed helix.

20. A method of changing the condition of an electronics module from a first condition to a second condition, said method comprising:

providing the electronics module in the first condition, the electronics module comprising a module housing and first and second torsional contacts connected to said module housing, each of said first and second torsional contacts comprising: (i) a body comprising a helix including at least one helical turn around a longitudinal axis, said body comprising first and second opposite ends that are spaced longitudinally from each other; and, (ii) first and second contact arms extending outwardly away from said helix at said opposite first and second ends of said body, respectively, wherein said second contact arms of said first and second torsional contacts are in contact with each other in said first condition;

inserting a circuit board between the first and second torsional contacts to deflect the respective second contact arms of the first and second torsional contacts away from each other to define said second condition of said electronics module in which the second contact arm of the first torsional contact is located on a first side of the circuit board and the second contact arm of the second torsional contact is located on a second side of the circuit board.

* * * * *